US005152084A

United States Patent [19]

Bonnaventure

[11] Patent Number: 5,152,084

[45] Date of Patent: Oct. 6, 1992

[54] REAR ENTRY SKI BOOT WITH A CLOSING STRAP COVER

[75] Inventor: Laurent Bonnaventure, Cran Gevrier, France

[73] Assignee: Salomon S.A., France

[21] Appl. No.: 811,297

[22] Filed: Dec. 20, 1991

[30] Foreign Application Priority Data

Dec. 20, 1990 [FR] France ..... 90 16369

[51] Int. Cl.[5] ..... A43B 5/04

[52] U.S. Cl. ..... 36/117; 36/50.5; 36/105; 36/132

[58] Field of Search ..... 36/50, 105, 109, 132, 36/117-121, 136, 138; 24/712.2, 685 K, 695 K, 715 K

[56] References Cited

U.S. PATENT DOCUMENTS

| | | | |
|---|---|---|---|
| 657,606 | 9/1900 | Lee | 24/712.6 |
| 990,991 | 5/1911 | Kuehner | 31/1 |
| 4,142,307 | 3/1979 | Martin | 36/50 |
| 4,759,137 | 7/1988 | Lederer | 36/120 |
| 4,788,781 | 12/1988 | Benoit | 36/117 |
| 4,823,484 | 4/1989 | Couty | 36/50 |
| 4,905,384 | 3/1990 | DeMarchi et al. | 36/117 |
| 5,007,186 | 4/1991 | Bischof et al. | 36/117 |

*Primary Examiner*—Jimmy G. Foster
*Assistant Examiner*—Thomas P. Hilliard
*Attorney, Agent, or Firm*—Pollock, Vande Sande & Priddy

[57] ABSTRACT

Rear-entry ski boot constituted as a whole by a rigid shell topped by an upper (1) and comprising a front cover (2) and a rear cover (3) hinged on a transverse pin. These covers are closed by a tightening system (8) incorporating a flexible connector (9) on which a guide device (15) on the rear cover (3) is covered with a movable cover (17) cooperating with the wall of this rear cover (3), and second, by a strap (30) which closes the top of the upper (1) and maintains it in position. The position-maintenance system on the strap (30) on the rear cover (3) is arranged on an upward extension (17*a*) of the cover (17) covering the guide device belonging to the connector, so as to form a single cover (31) for the guide or rear position-maintenance system (15) of the set of closing mechanisms.

8 Claims, 2 Drawing Sheets

REAR ENTRY SKI BOOT WITH A CLOSING STRAP COVER

FIELD OF THE INVENTION

The present invention concerns rear-entry alpine ski boots comprising a rigid shell of which one shell base is topped with an upper at least partially hinged on this latter and itself constituted by a rear part, or rear cover, that folds down toward a front part, or front cover, in order to close over the skier's lower leg by means of a series of closing mechanisms.

BACKGROUND OF THE INVENTION

The closing mechanisms are constituted, first, in a manner disclosed in French Patent No. 2 620 311, by a tightening system incorporating a flexible connector which secures the rear cover in a closed position against the front cover by means of a connector-guide device, which comprises a recess formed on the rear cover of the upper and oriented in the direction in which the connector runs and covered with a corresponding movable cover equipped with detachable attachment means cooperating with the wall of the rear cover in its rear upper area.

This system has the dual advantage of holding the flexible connector in proximity to the coupling means of the tension lever on the front cover when the rear cover is folded down on this latter, and second, on the rear cover, whatever its position, and, in particular, when it is disengaged from the front cover; and second, of incorporating the flexible connector and its guide means into the volume of the rear cover without exhibiting any roughness, while ensuring that the connector will slide and can potentially be replaced because of arrangements that make it movable.

Moreover, an additional conventional closing mechanism consists of an adjustable strap which holds the end of the top of the upper closed and which comprises position-maintenance means on said rear cover.

This strap essentially prevents flection of the top portion of the front cover of the boot and provides for maintaining the skier's lower leg in close contact, in order to prevent the feeling of freedom imparted by the upper widening of the front and rear covers.

This strap originates, or attaches, on the rear cover, thus constituting a dorsal upper-stiffening element, and surrounds and tightens the front cover before looping around itself at its free end by means of a buckle fastened to the rear cover with or without an auto-gripping device.

The position-maintenance means holding the strap on the rear cover are constituted by a first pair of rivets which clamp a collar attached to one of the free ends of the strap against the inner part of a lateral wing of the rear cover on its upper part. Another collar attached in identical fashion by two other rivets is positioned on the other later wing and carries the buckle.

This attachment of the strap has many disadvantages, in that it requires a specific mounting operation on the cover which is distinguished from that of the tightening system incorporating a flexible connector located at a lower level.

Furthermore, this strap-attachment technique makes it difficult, and indeed impossible, to replace the strap outside the workshop. In fact, the removal and reinsertion of the rivets requires the dismantling of the cover, and riveting is, in itself, a delicate operation requiring the appropriate tools.

The strap has a fragile texture as compared with the rest of the boot, e.g., the shell, and it can wear out because of its fragility and the number of operations it must perform when the boot is put on or removed. It must also be borne in mind that it is exposed to external agents, such as snow, ice, etc., as much as the shell itself, but has substantially lesser strength.

This situation leads one to think that the strap must be made easily interchangeable for the user, without requiring the assistance of a specialist or the use of tools, while reducing the work time to a strict minimum.

SUMMARY OF THE INVENTION

The object of the present invention is to achieve this result while solving all of the above-mentioned difficulties.

To this end, the invention relates to a boot of the above-mentioned type, comprising a set of closing mechanisms, i.e., a tightening system incorporating a flexible connector and a adjustable strap which holds the end of the top portion of the upper in place, characterized by the fact that the means for holding the rear cover in position on the rear cover are arranged on an upward extension of the cover covering the connector-guide device so as to constitute a single cover of the guide, or rear position-maintenance means of the set of closing mechanisms.

It will be easily understood from the preceding that, since the means for attaching the strap have been transferred onto an extension of the cover which had previously cooperated with the connector-guide device, a complex strap-mounting operation has been eliminated.

According to another invention feature, the extension comprises, on its upper part, an internal transverse recess delimiting a loop with the wall of the rear cover, on which rests the end of the single cover, so as to constitute the means for securing the strap in place.

According to another feature of the invention, the transverse recess forming a loop comprises means for immobilizing the strap as regards sideways motion after positioning.

BRIEF DESCRIPTION OF THE DRAWINGS

The invention will be better understood by referring to the following description provided with respect to the attached drawings illustrating one embodiment of the invention, and in which.

DETAILED DESCRIPTION

Figure 1:
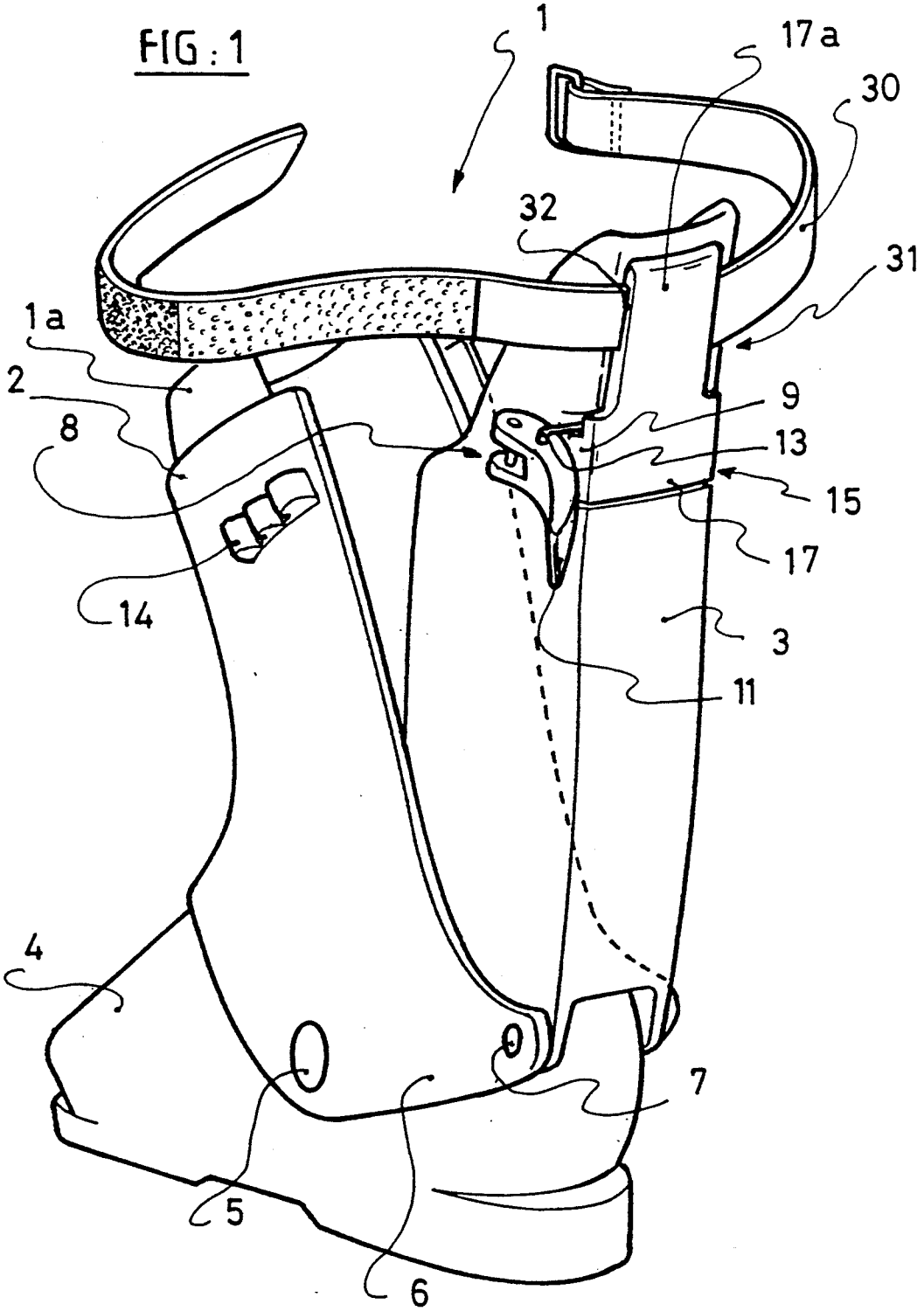
FIG. 1 is a perspective view of a ski boot fitted with a single cover for the rear means of securing in place the series of closing mechanisms according to the invention.

In accordance with the invention, the ski boot shown in FIG. 1 has an upper 1 constituted by a front part 2, or front cover, and rear part 3, or rear cover, and a shell base 4 on which the upper 1 is attached using rivets 5. In this construction example, the rear cover 3 is mounted in a hinged arrangement on lower lateral extensions 6 of the front cover by means of a transverse pin 7. The system 8 for tightening and closing the upper 1 of the boot on the skier's lower leg comprises, in a conventional manner, a tension lever 11 which secures under tension a flexible connector 9, such as a cable loop, which is fastened on the front cover 2 by its two ends, while its intermediate part passes around the rear cover 3. One of the ends of the loop (not shown)is mounted on an anchoring pin (not shown on the front cover), while the other end 13 of this loop is connected to the tension lever 11, which cooperates with the notches of a rack 14 fastened on said front cover.

Figure 2:
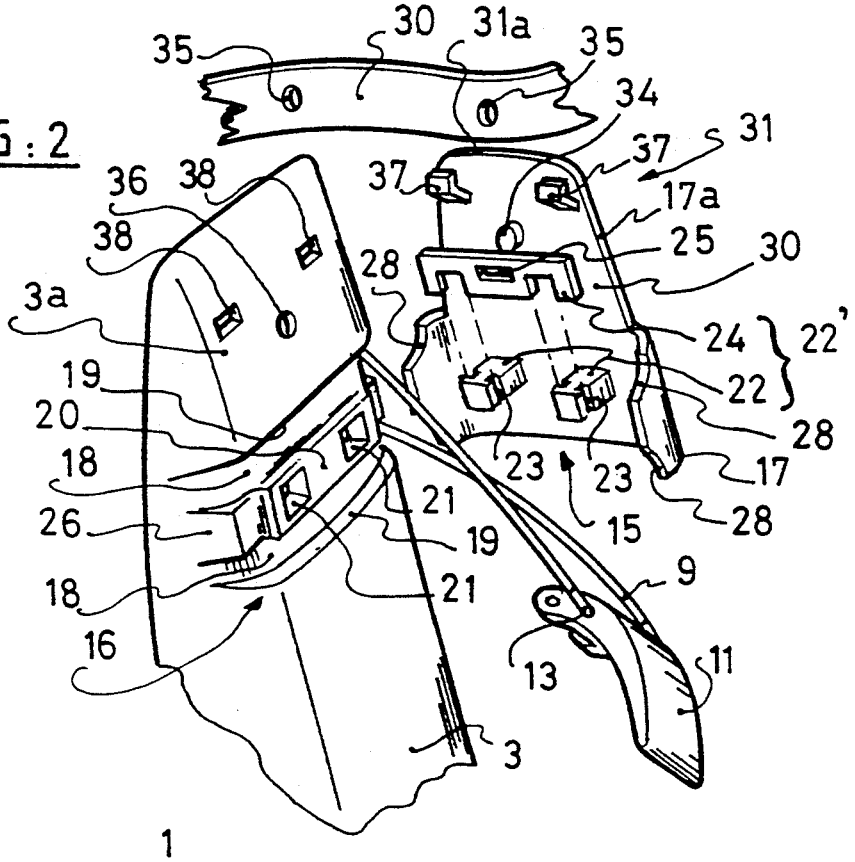
FIG. 2 is an exploded perspective view of the rear means for securing in position the series of closing mechanisms in FIG. 1.
Figure 3:
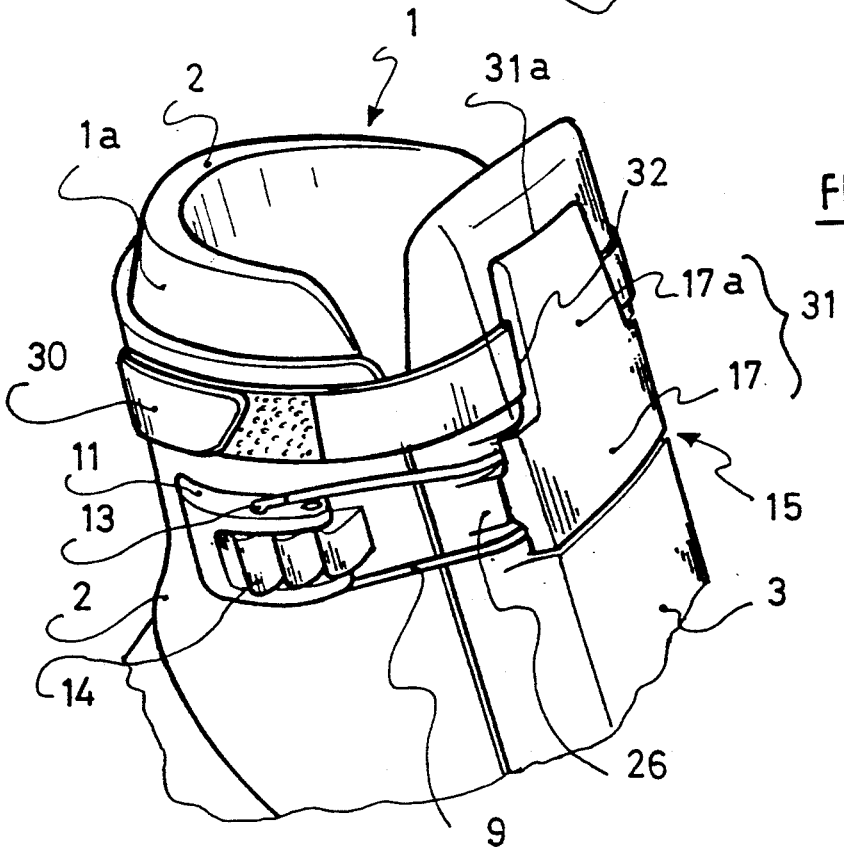
FIG. 3 is a view from the top of the upper of the boot according to FIG. 1, after the closing mechanisms have been tightened.

A device 15 for guidance of the cable 9 forming the loop is connected and incorporated into the rear cover in the area corresponding to that traversed by the cable 9 in its functional position, as shown in FIG. 3. In this position, the cable is under tension generated by the tension lever 11 engaged in the rack 14, and its intermediate part, which surrounds the rear cover 3, causes pivoting of the latter and holds it against the front cover 2. The guide device 15 shown in FIGS. 1 to 3 comprises a recess 16 on the rear cover 3 and a movable cover 17 which fits on said recess in complementary fashion. Since the recess 16 is positioned transversely to the axis of the upper, this recess has two guide channels 18, each of which is delimited transversely by the wall of the cover 3, which forms shoulders 19, and by a central projection 20, each channel thus delimited allowing passage of a section of the cable 9. Furthermore, two openings 21 produced in the central projection 20 pass through the wall of the cover 3 and cooperate with means 22' for attaching the cover 17 on the cover 3. The cover 17 is provided with two notches 28 complementary to the guide channels 18 and with two lugs 22 forming a portion of the attachment means 22' and whose spacing and dimensions correspond to openings 21. The respective end of the lugs 22 emerge inside the cover 3 and comprises vertical grooves 23 designed to house a stop 24 which fits into these grooves, thereby securing the lugs in position on the cover. This stop 24 is retractable by means of an operating notch 25. Moreover, lateral bosses 26 on the rear cover 3 constitute support stops for the cover 17 on the rear cover.

The boot also comprises an adjustable strap 30 which holds the end 19 of the upper 1 closed and comprising position-maintenance means on the rear cover 3.

According to the invention, the means for holding the strap 30 in position on the rear cover 3 are arranged on an extension 17*a* extending toward the top of the cover 17 covering the connector 9-guide device so as to form a single cover 31 for the guide or rear position-maintenance means of the entirety of the closing mechanisms.

The means for holding the strap 30 in position are constituted by a loop 32 formed both by an inner transverse recess 33 and by the upper part 3*a* of the rear cover 3, on which the end 31*a* of the single cover 31 rests.

The transverse recess 33 forming the loop 32 comprises means for holding the strap 30 in position without sideways motion, after the strap has been positioned.

These stop means are constituted by a cylindrical piece 34 which projects upward on the bottom of the recess 33 of the single cover 31 and whose dimensions allow it to engage in one of the cylindrical holes 35 in the strap 30 positioned in the loop 32. The hole 35 is chosen as a function of a subsequent predetermined adjustment.

To ensure that the strap 30 does not slide sideways off the piece 34 after mounting, this piece is made high enough to be able to be fitted, during mounting, into a corresponding hole 36 in an area facing the rear cover 3.

Furthermore, the single cover 31 comprises, in its end-support area 31*a*, upper, detachable attachment means which cooperate with the wall of the rear cover 3.

These means are formed by two hooks 37 extending upward and whose inner vertical plane is separated from the bottom of the recess 33 by a distance at least equal to the thickness of the wall of the rear cover 3. In fact, these hooks 37 are designed to be engaged, in a downward, slightly inclined motion, in corresponding engagement slots 38 in the rear cover 3, and to beheld there. After a pivoting motion of the cover 31 toward the cover 3, while being supported on the inner wall of the cover 3 in an area adjoining the slots 38.

The above-mentioned pivoting of the cover 31 causes part 178 of the single cover 31 to be pressed against the cover 3, which brings about the engagement of the lugs into the corresponding openings 21 of the system 8 for tightening the flexible connector 9. One need then only engage the stop 24 in the grooves 23 on the other side of the wall of the cover 3 in order to stop and ensure the final attachment of the single cover.

The single cover is advantageously obtained simultaneously with the upper hooks 27, piece 34, and the lower lugs 22 during a single molding operation using a plastic material.

Of course, piece 34 can also be produced on the rear cover 3. In this case, in a reversed arrangement, the housing 36 will be produced on the inner wall of the cover 31.

The exterior contour of the single cover 31 is adjusted so as to substantially match the rear cover 3, thereby producing continuity with the latter.

What is claimed is:

1. Rear-entry alpine ski boot, comprising a rigid shell of which a shell base (1) is topped by an upper (1) at least partially hinged on said base and itself comprising a rear part, or rear cover (3) that can fold down toward a front part, or front cover (2), a set of closing mechanisms being constituted, first, by a tightening system (8) incorporating a flexible connector (9) which fastens said rear cover (3) in a closed position against said front cover (2) by means of a connector-guide device (15), which is constituted by a recess (16) on said rear cover of said upper and positioned in the direction in which the connector (9) runs and covered by a corresponding movable cover (17) equipped with detachable attachment means (21, 22, 24) which cooperate with the wall of the rear cover (30) in its upper rear areas; and second, by an adjustable strap (30) which holds the end (1*a*) of the top of said upper (1) closed, said strap having rear cover position-maintenance means wherein said means for holding said strap (30) in place on said rear cover (3) are arranged on an upward extension (17*a*) of said cover (17) which covers the connector-guide device so as to form a single cover (31) for the connector-guide device (15) and rear position-maintenance means which secure the set of closing mechanisms.

2. Boot according to claim 1, wherein the upper part of said extension comprises an inner transverse recess (33) delimiting a loop (32) with a wall of said rear cover (3), on which rests an end (31*a*) of said single cover (31), so as to constitute means for holding said strap (30) in position.

3. Boot according to claim 2, wherein said transverse recess (33) forming a loop (34) comprises means for holding said strap (30) in place without side motion after positioning.

4. Boot according to claim 3, wherein said means for securing said strap (30) in position ar constituted by at least one piece (34) projecting outward on the bottom of said recess (33) and whose dimensions make it suitable to be engaged in a hole (35) in said strap (30) positioned in said loop (32), said hole (35) being selected as a function of a predetermined adjustment to be effected.

5. Boot according to claim 4, where said piece (34) fits into a corresponding hole (36) in said rear cover (3) after passing through one of said holes (35) in said strap (30).

6. Boot according to claim 1, wherein said single cover (31) comprises, in its area supporting an upper end (31*a*), detachable upper attachment means cooperating with a wall of said rear cover (3).

7. Boot according to claim 6, wherein said upper attachment means of said cover comprise at least one hook (37) extending upward and capable of being engaged, using a downward motion, in a corresponding engagement slot (38) in said rear cover (3) and of being held there while being supported on its inner wall in an area adjacent to said slot (38), the final attachment of said single cover (31) being effected on its lower part, after said connector (9) has been positioned in its guide device (15).

8. Boot according to claim 1, wherein said single cover (31) is made of plastic material during a single molding operation.

* * * * *